US005787973A

United States Patent [19]

Kado et al.

[11] Patent Number: 5,787,973

[45] Date of Patent: Aug. 4, 1998

[54] HEAT EXCHANGER

[75] Inventors: Hirotaka Kado, Isesaki; Akimichi Watanabe, Maebashi, both of Japan

[73] Assignee: Sanden Corporation, Gunma, Japan

[21] Appl. No.: 637,275

[22] Filed: Apr. 25, 1996

[51] Int. Cl.[6] ..... F28D 1/02

[52] U.S. Cl. ..... 165/153; 165/178; 165/175

[58] Field of Search ..... 165/153, 173, 165/174, 175, 176, 916, 178, 76; 29/890.043, 890.052

[56] References Cited

U.S. PATENT DOCUMENTS

| | | | |
|---|---|---|---|
| 1,438,596 | 12/1922 | Harding | 29/890.052 |
| 1,583,758 | 5/1926 | White | 29/890.052 |
| 2,164,629 | 7/1939 | Sibley | 29/890.043 X |
| 3,245,465 | 4/1966 | Young | 165/173 X |
| 3,708,012 | 1/1973 | Zimprich | 165/152 |
| 3,993,126 | 11/1976 | Taylor | 165/173 |
| 4,234,041 | 11/1980 | Melnyk | 165/173 |
| 4,369,837 | 1/1983 | Moranne | 165/175 |
| 4,615,385 | 10/1986 | Saperstein et al. | 165/175 |
| 4,678,112 | 7/1987 | Koisuka et al. | 228/138 |
| 4,730,669 | 3/1988 | Beasley et al. | 165/151 |
| 4,739,828 | 4/1988 | Bayer et al. | 165/173 |
| 4,957,158 | 9/1990 | Ando | 165/110 |
| 5,101,887 | 4/1992 | Kado | 165/76 |
| 5,119,552 | 6/1992 | Sutou et al. | 29/890.052 |
| 5,318,114 | 6/1994 | Sasaki | 165/176 |
| 5,327,959 | 7/1994 | Saperstein et al. | 165/153 X |
| 5,366,006 | 11/1994 | Lu et al. | 165/173 |

FOREIGN PATENT DOCUMENTS

| | | | |
|---|---|---|---|
| 0326813 | 8/1989 | European Pat. Off. | 165/173 |
| 0551545 | 7/1993 | European Pat. Off. | 165/916 |
| 59-225900 | 12/1984 | Japan . | |
| 0434640 | 10/1967 | Switzerland | 29/890.052 |
| 0122205 | 6/1917 | United Kingdom | 165/153 |

*Primary Examiner*—Ira S. Lazarus
*Assistant Examiner*—Christopher Atkinson
*Attorney, Agent, or Firm*—Baker & Botts, L.L.P.

[57] ABSTRACT

A heat exchanger includes a header having tube insertion holes and heat transfer tubes, wherein each of the heat transfer tubes has an end portion inserted into a corresponding tube insertion hole. A burr is formed on a wall of the header around each tube insertion hole to extend in a direction toward an interior of the header. The burr has a bent tip portion formed by bending at least a part of a tip portion of the burr inwardly. A tip of the end portion of each heat transfer tube inserted into a corresponding tube insertion hole contacts with the bent tip portion of the burr. The bent tip portion of the burr seals a gap formed between an outer surface of the inserted end portion of the tube and an inner surface of the burr when the header and the tubes are assembled and brazed, thereby preventing leakage of a heat exchange fluid through such a gap. The insertion depth of the tube is reduced by the bent tip portion of the burr, thereby decreasing pressure loss in the header.

13 Claims, 6 Drawing Sheets

HEAT EXCHANGER

BACKGROUND OF THE INVENTION

1. Field of the Invention

The present invention relates to a heat exchanger, and more particularly to an improved connection structure between a header and a heat transfer tube in the heat exchanger.

2. Description of the Related Art

In a conventional heat exchanger having a header and a heat transfer tube connected to the header, a burr for enlarging a connection area between the header and an end portion of the heat transfer tube inserted into the tube insertion hole may be formed on a wall of the header around a tube insertion hole defined on the wall. In such a connection structure, however, it is generally difficult to control the depth of tube insertion into the header. If the tube insertion depth is relatively large, a pressure loss in the header caused by the inserted portion of the tube increases.

Further, in the above-described conventional connection structure, when the heat transfer tube is formed as a flat tube, problems may arise due to deformation of the tube. For example, as shown in FIG. 9, when the assembly including header 101 and heat transfer tube 102 is fixed using fixing jigs (not shown) for handling and brazing, heat transfer tube 102 formed as a flat tube may subsequently be deformed by force applied by the fixing jigs, and the end portion of transfer tube 102 inserted into tube insertion hole 103 may also be deformed by the force. As a result, a gap 104 may be created between an outer surface of the inserted end portion of transfer tube 102 and an inner surface of burr 105 formed around tube insertion hole 103. If a brazing material is not supplied in sufficient quantity into gap 104, fluid leaks may occur through the gap 104 during operation of the heat exchanger.

In order to avoid this disadvantage, for example, Japanese Utility Model Laid-Open HEI 5-17385 discloses a structure as shown in FIG. 10. In FIG. 10, a burr 111 is formed around tube insertion hole 112 defined on header wall 113. Heat transfer tube 114 is inserted into tube insertion hole 112, so that its end portion 115 extends over burr 111 in header 116. After insertion, end portion 115 of tube 114 is expanded outwardly in order to prevent the creation of a gap between the outer surface of the tube 114 and the inner surface of burr 111.

In such a structure, however, because end portion 115 of tube 114 is inserted into header 116 up to a position over burr 111 and the expanded end portion 115 is present at a position over burr 111 in header 116, the pressure loss in header 116 again increases. Further, when heat transfer tube 114 is constructed from an aluminum alloy clad with a corrosion resistant layer (for example, an Al-Zn alloy) on its inner surface for the purpose of avoiding corrosion, because the outer surface and the edge of the inserted end portion 115 of tube 114 protruding into the interior of header 116 are not clad with the corrosion resistant layer and are exposed directly to a fluid in header 116, tube 114 is likely to be corroded from such portions. In particular, when the fluid is water, such a corrosion of the non-protected portions of the tube are likely to occur. Further, generally, clad, corrosion resistant layer may become delaminated due to a shearing force due to water or the impact of water at a portion of water inlet side of a heat transfer tube. Thus, corrosion, i.e., turbulence corrosion or inlet tube corrosion may be accelerated, and a fluid may be leaked. When a heat transfer tube protrudes in a tank as depicted in the structure of Japanese Utility Model Laid-Open HEI 5-17385, water turbulence is likely to occur near the water inlet of heat transfer tube 114, and turbulence corrosion or inlet tube corrosion also is likely to occur.

SUMMARY OF THE INVENTION

It is an object of the present invention to provide a heat exchanger having a connection structure between a tank and a heat transfer tube which may readily control an insertion depth of the heat transfer tube into an interior of the tank, thereby decreasing a pressure loss in the tank.

It is another object of the present invention to prevent fluid leakage through a gap which may be formed between a deformed heat transfer tube and a burr provided around tube insertion hole defined on a header wall.

It is a further object may be the present invention to reduce or eliminate turbulence corrosion or inlet tube corrosion at an edge or an outer surface of an inserted end portion of a heat transfer tube clad with a corrosion resistant layer.

These and other objects may be achieved by a heat exchanger according to the present invention. The heat exchanger includes at least a header having at least one tube insertion hole and at least one heat transfer tube having an end portion inserted into the at least one tube insertion hole. The heat exchanger further comprises at least one burr formed on a wall of the header around the at least one tube insertion hole to extend in a direction toward an interior of the header. The at least one burr has a bent tip portion formed by bending at least a part of a tip portion of the burr inwardly. A tip of the end portion of the at least one heat transfer tube inserted into the at least one tube insertion hole is brought into contact with the bent tip portion of the at least one burr.

In such a heat exchanger, the tip of the end portion of the at least one heat transfer tube inserted into the at least one tube insertion hole engages the bent tip portion of the burr, and the insertion depth thereof may be readily controlled, for example, to a predetermined depth. Therefore, the pressure loss in the header caused by the inserted tube portion may be decreased as compared with a conventional structure having a relatively large insertion depth (for example, 3–5 mm) of a tube.

Further, because the bent tip portion of the burr is formed by bending at least a part of the tip portion of the burr inwardly, even if a gap is formed between an outer surface of the inserted tube end portion and an inner surface of the burr by an external force applied from, for example, jigs used for assembling or brazing, the formed bent tip portion may seal the gap. Therefore, such a gap may be sealed by the bent tip portion, and a fluid leakage may be prevented.

Moreover, because the tube insertion depth of the end portion of the heat transfer tube may be reduced to a small depth corresponding to about a height of the burr (for example, not more than 3 mm), the outer surface of the end portion of the tube is covered by the inner surface of the burr and at least a part of the edge (tip) of the tube is covered by the bent tip portion of the burr. Therefore, when a heat transfer tube is clad with a corrosion resistant material on its inner surface, an area of a portion of the tube in direct contact with a heat exchange fluid may be reduced in size or minimized. As a result, the corrosion resistant property of the heat transfer tube may be greatly improved. Further, because at least a part of the inlet edge of the inserted tube is covered and protected by the bent tip portion of the burr, turbulence corrosion or inlet tube corrosion at or near the edge may be reduced or eliminated.

Further objects, features, and advantages of the present invention will be understood from the following detailed description of the embodiments of the present invention with reference to the appropriate figures.

BRIEF DESCRIPTION OF THE DRAWINGS

Some embodiments of the invention will now be described with reference to the appropriate figures, which are given by way of example only, and are not intended to limit the present invention.

DETAILED DESCRIPTION OF PREFERRED EMBODIMENTS

Figure 1:
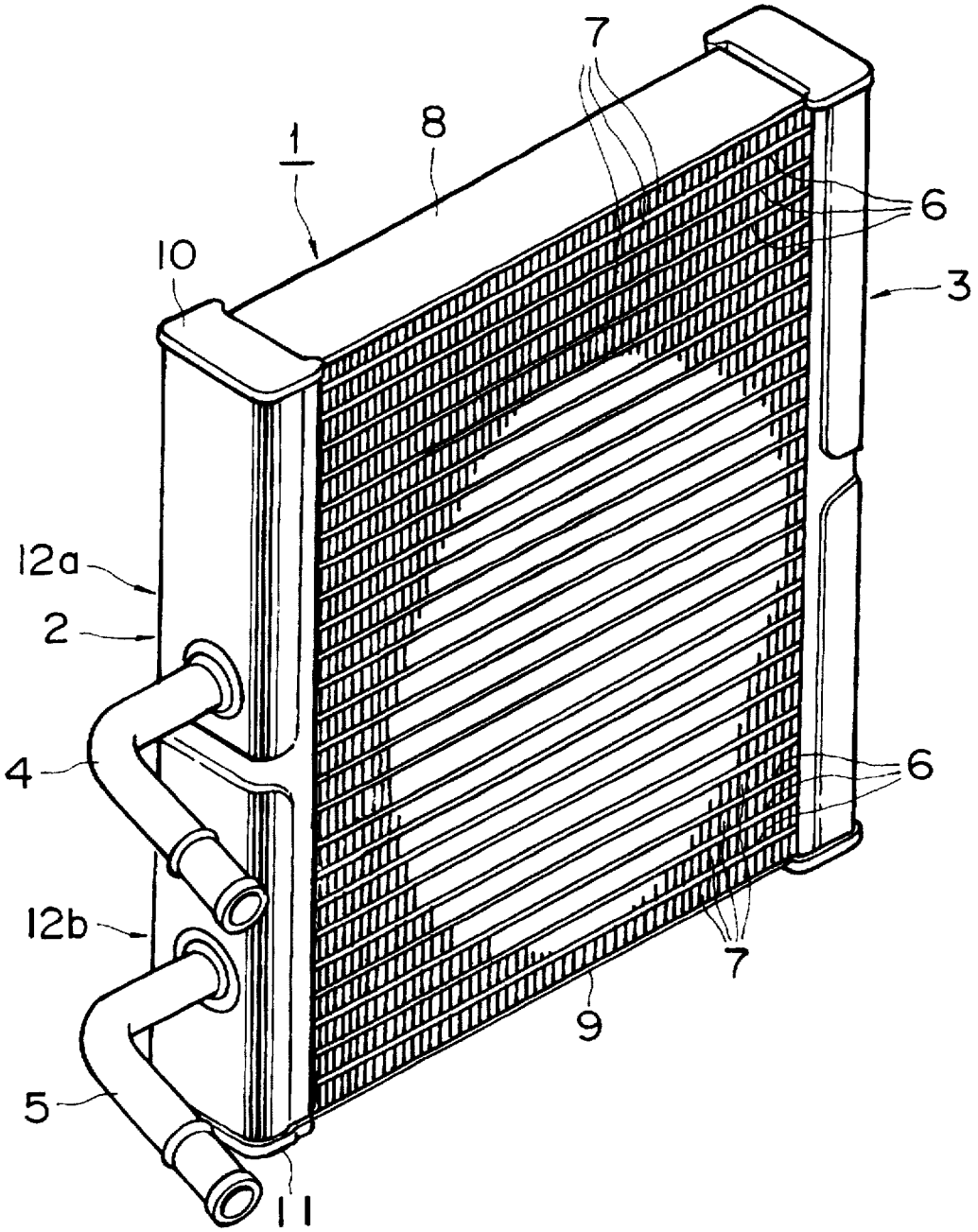
FIG. 1 is a perspective view of a heat exchanger according to a first embodiment of the present invention.
Figure 2:
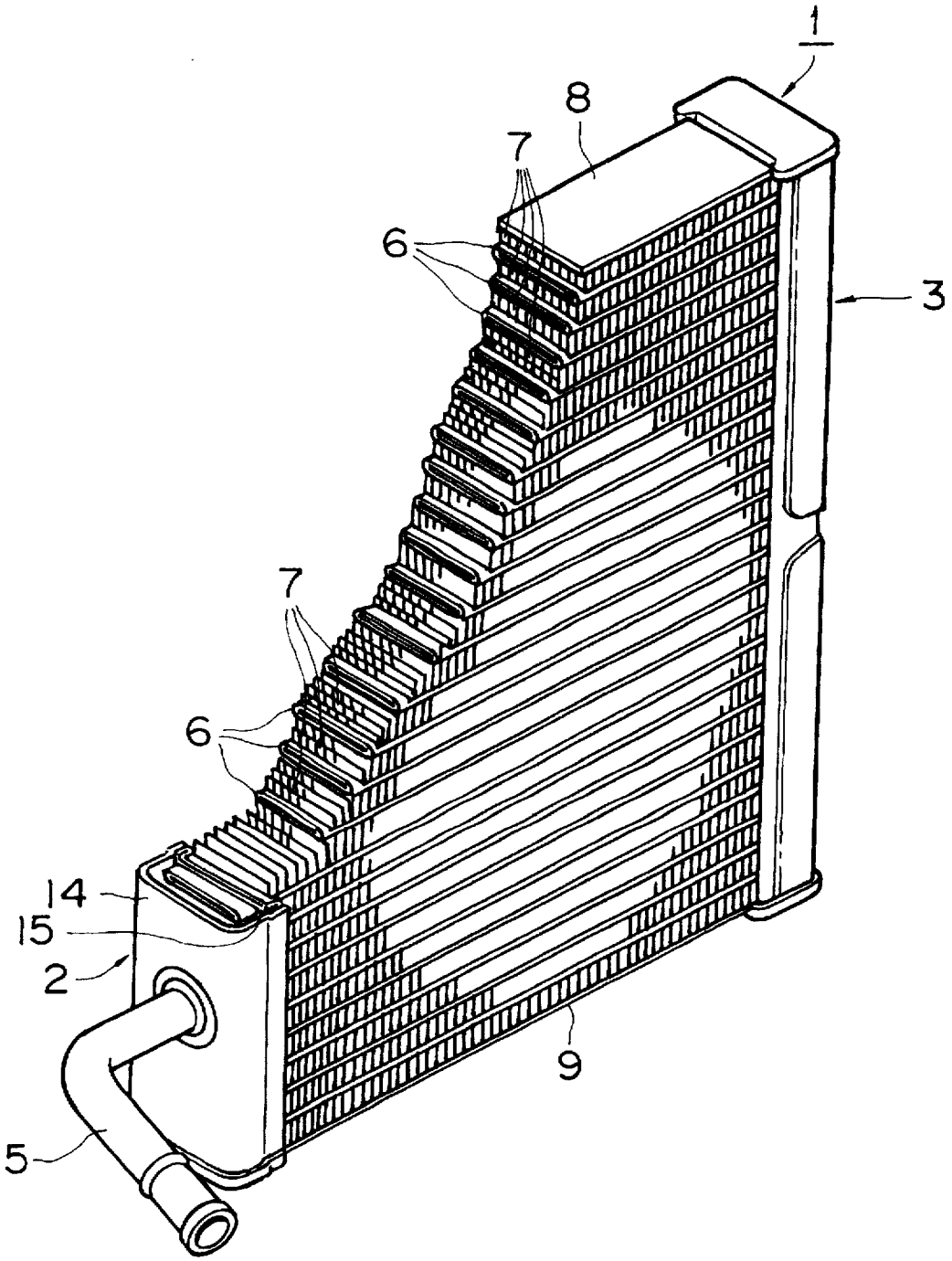
FIG. 2 is a partially cut away perspective view of the heat exchanger depicted in FIG. 1.
Figure 3:
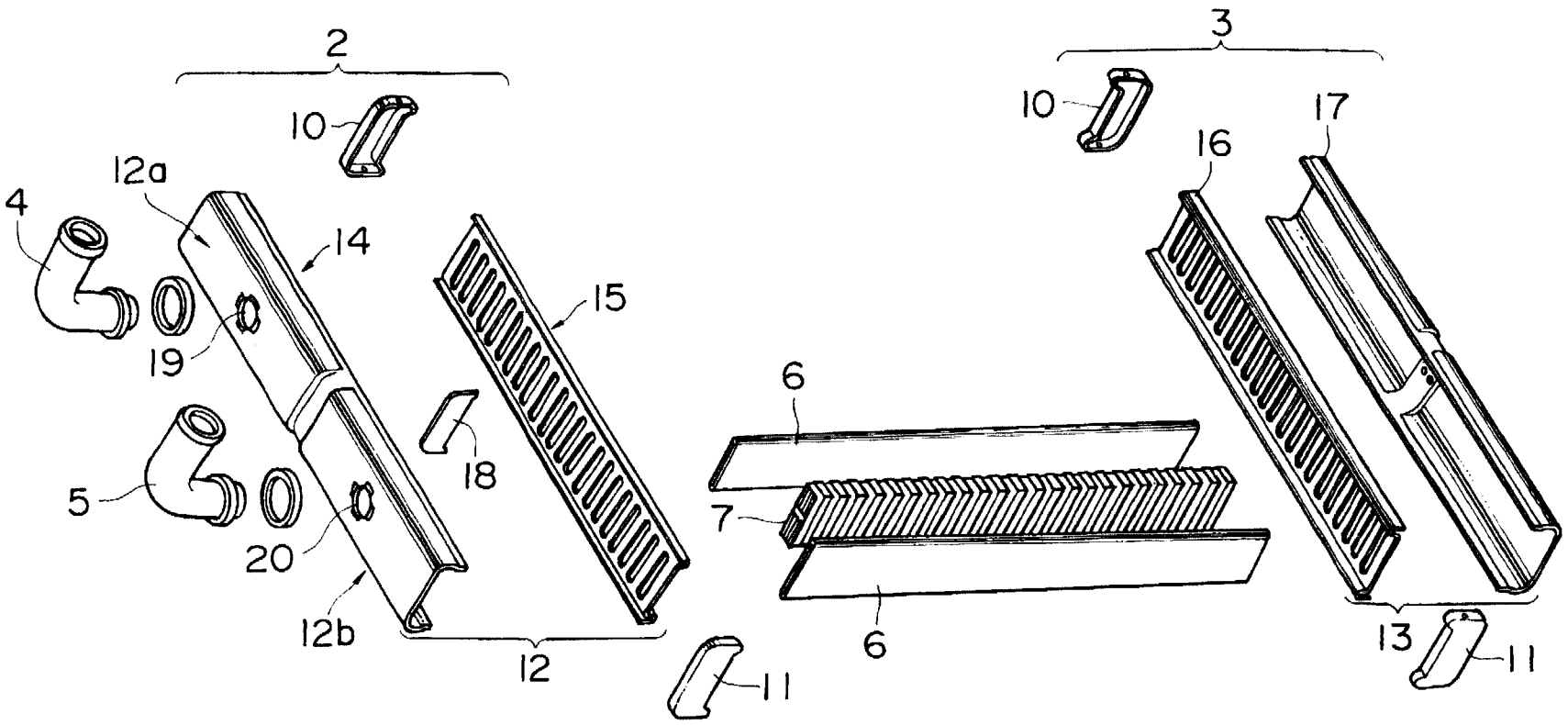
FIG. 3 is an expanded perspective view of the heat exchanger depicted in FIG. 1.

Referring to FIGS. 1–3, a heat exchanger 1 is provided according to a first embodiment. Heat exchanger 1 includes a pair of headers 2 and 3. Each of headers 2 and 3 is constructed from tank member 14 or 17 and seat member 15 or 16 to form barrel 12 or 13. Each of inlet pipe 4 and outlet pipe 5 is connected to pipe insertion hole 19 or 20, respectively, defined on tank member 14 of header 2. A plurality of flat heat transfer tubes 6 (for example, refrigerant tubes) are fluidly interconnected between headers 2 and 3. In this embodiment, flat heat transfer tube 6 is formed as a flat tube. Corrugated fins 7 are disposed on both surfaces of each heat transfer tube 6. Side members 8 and 9 are provided on the upper surface of the uppermost fin 7 and on the lower surface of the lowermost fin 7, respectively. Each of headers 2 and 3 is sealed at both open ends by caps 10 and 11, respectively. The interior of header 2 is divided into two sections 12a and 12b by partition 18 provided in header 2.

Figure 4:
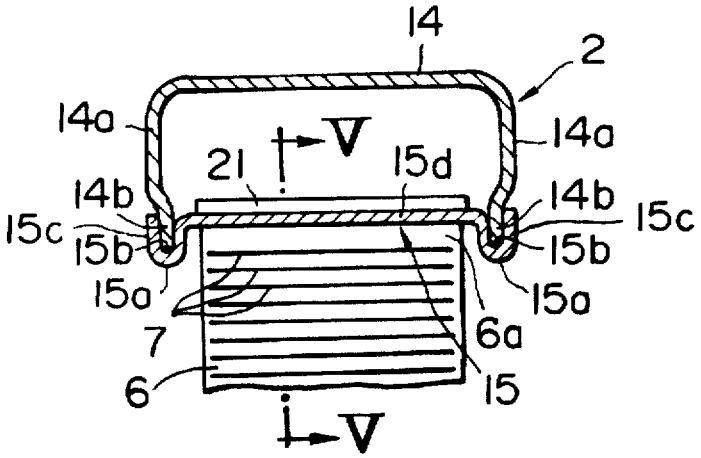
FIG. 4 is an enlarged cross-sectional view of a header of the heat exchanger depicted in FIG. 1.

As depicted in FIG. 4, header 2 has a substantially rectangular cross-section and is formed as barrel 12 when tank member 14 and seat member 15 are joined to each other. In this embodiment, seat member 15 has curved portions **15*a* provided on both end portions thereof in the radial direction for forming grooves 15*b* open toward tank member 14. Tank member 14 has a U-shape cross section and has side walls 14*a* on both end portions in its radial direction. Each side wall 14*a* has free end portion 14*b* extending toward the tip of the side wall 14*a*. Each free end portion 14*b* is offset inwardly by an amount substantially equal to the thickness of bent portion 15*c* of seat member 15 measured at the tip portion of curved portion 15*a*. Free end portions 14*b* of tank member 14 are inserted into the respective grooves 15*b* of seat member 15. Seat member 15 and tank member 14 are brazed to each other to form barrel 12** having a substantially rectangular cross-section, as described above.

Burr 21 is formed on wall **15*d* of seat member 15 at a position around tube insertion hole 22, so as to extend toward an interior of header 2. End portion 6*a* of heat transfer tube 6 is inserted into tube insertion hole 22 along burr 21. Although FIG. 4 shows the side of header 2, the side of header 3** may have substantially the same structure with respect to the tube connection structure.

Figure 5:
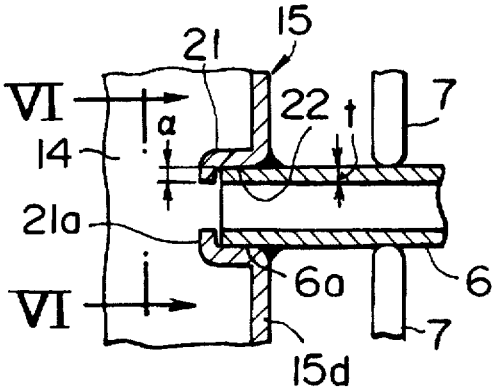
FIG. 5 is an enlarged vertical sectional view of the header and an end portion of a heat transfer tube of the heat exchanger depicted in FIG. 4, as viewed along V—V line of FIG. 4.
Figure 6:
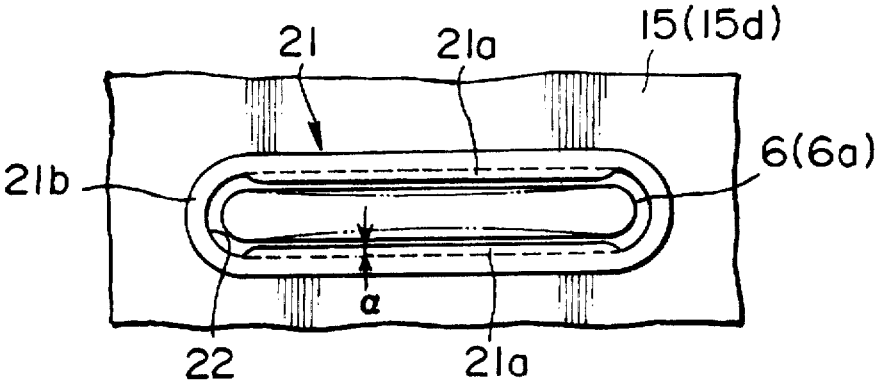
FIG. 6 is an elevational view of a tube-header connection portion of the heat exchanger depicted in FIG. 5, as viewed along VI—VI line of FIG. 5.
Figure 7:
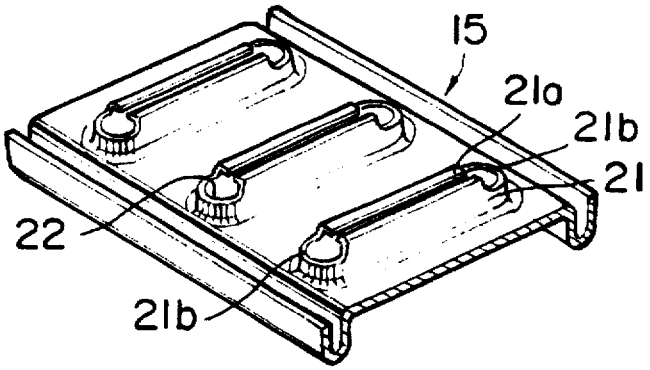
FIG. 7 is a perspective view of a part of a header of the heat exchanger depicted in FIG. 5.

As depicted in FIGS. 5–7, tube insertion hole 22 is formed as a slot having two lateral edges and two longitudinal edges, and burr 21 has a cross-section along the tube insertion hole 22. Burr 21 has a pair of first tip portions **21*a* and a pair of second tip portions 21*b*, wherein a first length of first tip portions 21*a* is greater than a second length of second tip portions 21*b*. Each of the pair of first tip portions 21*a* is bent inwardly to form a bent tip portion. The pair of bent tip portions 21*a* extend along the lateral edges of the slot of tube insertion hole 22. Each bent tip portion 21*a* extends inwardly by a length "α" equal to or less than thickness "t" of end portion 6*a* of heat transfer tube 6. A tip of end portion 6*a* of heat transfer tube 6 inserted into tube insertion hole 22 contacts with bent tip portions 21*a* of burr 21. In such a condition, heat transfer tube 6 is brazed to seat member 15 of header 2. Heat transfer tube 6 may also be connected to header 3** by the same connection structure.

The respective members described above are constructed from aluminum or an aluminum alloy. After the members are assembled, the assembly may be temporarily fixed and placed in a furnace for heating and brazing.

In such a heat exchanger 1, the tip of end portion **6*a* of heat transfer tube 6 inserted into tube insertion hole 22 contacts with bent tip portions 21*a* of burr 21, and the insertion depth of the end portion 6*a* may be readily controlled to a predetermined small depth (for example, not more than 2.5 mm). Therefore, the pressure loss in header 2** caused by the inserted tube portion may be decreased as compared with a conventional structure having a relatively large insertion depth (for example, 3–5 mm) of a tube.

Further, because the bending length "α" of each bent tip portion **21*a* of burr 21 is equal to or less than thickness "t" of end portion 6*a* of heat transfer tube 6, the bent tip portion 21*a* does not protrude into the interior of heat transfer tube 6. Therefore, the pressure loss in heat transfer tube 6 does not increase due to bent tip portion 21*a* of burr 21**.

As mentioned above, end portion **6*a* of heat transfer tube 6 may be deformed inwardly when applied with external force for fixing the assembly of header 2 and tube 6 for heating and brazing. Thus, a gap may form between the outer surface of the end portion 6*a* and the inner surface of burr 21, as shown by dashed lines in FIG. 6. In this embodiment, however, each bent tip portion 21*a* of burr 21 extends along the lateral edge of the slot of tube insertion hole 22 and may cover and seal such a gap. Heat transfer tube 6 is brazed to header 2** maintaining such a gap-sealed condition. Therefore, fluid leakage through the gap may be appropriately prevented.

Further, because the tube insertion depth of end portion **6*a* of heat transfer tube 6 is reduced to a small depth corresponding to about a height of burr 21, the outer surface of end portion 6a is covered by burr 21. The height of burr 21 may be controlled, for example, in the range of 2–3 mm. Moreover, at least a part of the edge (tip) of inserted end portion 6a of heat transfer tube 6 is covered by bent tip portion 21a of burr 21 (in the embodiment of FIG. 6, most of the edge is covered). Therefore, even when heat transfer tube 6 is clad with a corrosion resistant material on its inner surface, an area of a portion of the tube 6 directly exposed to a heat exchange fluid along non-clad portions may be reduced to an extremely small area or minimized. The directly exposed area may be controlled to be not more than 20 $mm^2$ per one end portion of tube 6. Thus, only a small part of the edge of end portion 6a of heat transfer tube 6 contacts the heat exchange fluid. As a result, the corrosion resistant abilities of heat transfer tube 6** may be greatly improved.

Moreover, in this embodiment, because a pair of bent tip portions 21a are formed along the lateral edges of the slot of tube insertion hole 22, the entrance shape of heat transfer tube 6 as an water inlet port becomes a smooth shape. Therefore, turbulence of the heat exchange fluid is reduced or eliminated. In addition, most of the edge of end portion 6a of heat transfer tube 6 is covered with bent tip portion 21a of burr 21, as described above. As a result, turbulence corrosion or inlet tube corrosion at or near the edge is reduced or eliminated.

Figure 8:
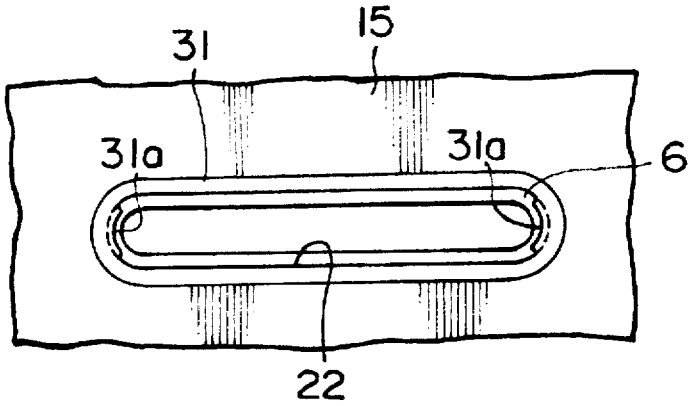
FIG. 8 is an elevational view of a tube-header connection portion of a heat exchanger according to a second embodiment of the present invention.
Figure 9:
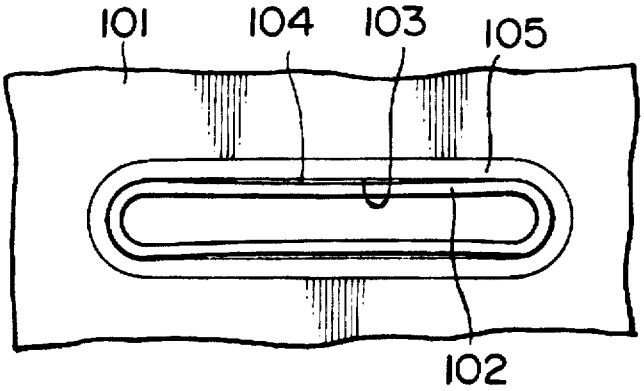
FIG. 9 PRIOR ART
FIG. 9 is an elevational view of a tube-header connection portion of a conventional heat exchanger.
Figure 10:
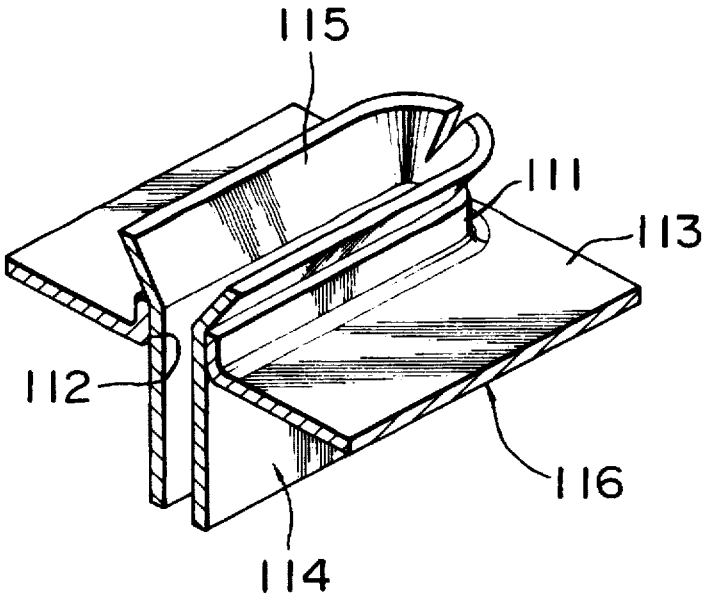
FIG. 10 PRIOR ART
FIG. 10 is a perspective view of a tube-header connection portion of another conventional heat exchanger.

FIG. 8 shows a tube-header connection structure according to a second embodiment of the present invention. In this embodiment, a pair of bent tip portions 31a of burr 31 are formed on the respective second tip portions of burr 31 positioned along the longitudinal edges of a slot of tube insertion hole 22. Even in such a structure, however, the tube insertion length of heat transfer tube 6 may be controlled to a predetermined desired small length.

Although the side of header 2 has been explained hereinabove, the side of header 3 may be substantially the same structure as that of header 2.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A heat exchanger comprising:

at least one header having at least one tube insertion hole and at least one heat transfer tube having an end portion inserted into said at least one tube insertion hole; and at least one burr formed on a wall of said header around said at least one tube insertion hole to extend in a direction toward an interior of said header, said burr having a bent tip portion formed by bending at least a part of a tip portion of said burr inwardly, a tip of said end portion of said at least one heat transfer tube inserted into said at least one tube insertion hole coming into contact with said bent tip portion of said at least one burr wherein said bent tip portion extends inwardly to a depth equal to or less than a thickness of said end portion of said at least one heat transfer tube.

2. The heat exchanger of claim 1, wherein said at least one burr has a first tip portion and a second tip portion, wherein a first length of said first tip portion is greater than a second length of said second tip portion, and said first tip portion is bent for forming said bent tip portion.

3. The heat exchanger of claim 1, wherein said at least one burr has a pair of first tip portions and a pair of second tip portions, wherein a first length of said first tip portions is greater than a second length of said second tip portions, and each of said pair of first tip portions is bent for forming said bent tip portion.

4. The heat exchanger of claim 3, wherein said at least one heat transfer tube is formed as a flat tube, and said at least one tube insertion hole is formed as a slot having two lateral edges and two longitudinal edges.

5. The heat exchanger of claim 4, wherein said bent tip portion is formed on each of said first tip portions of said at least one burr positioned along said lateral edges of said at least one slot.

6. The heat exchanger of claim 4, wherein said bent tip portion is formed on each of said second tip portions of said at least one burr positioned along said longitudinal edges of said at least one slot.

7. The heat exchanger of claim 1, wherein said header further comprises a tank member and a seat member connected to each other to form a barrel, and said seat member includes said at least one tube insertion hole and said at least one burr.

8. The heat exchanger of claim 1, wherein said end portion of said at least one heat transfer tube is brazed to said header.

9. The heat exchanger of claim 1, wherein a corrosion-resistant layer is clad on an inner surface of said at least one heat transfer tube.

10. The heat exchanger of claim 9, wherein said corrosion-resistant layer is formed from an Al-Zn alloy.

11. The heat exchanger of claim 1, wherein said heat exchanger has a plurality of heat transfer tubes, and a fin is disposed between adjacent heat transfer tubes.

12. The heat exchanger of claim 1, wherein said heat exchanger has a pair of headers, a plurality of heat transfer tubes interconnected between said pair of headers, and a plurality of fins, such that at least one of said fins is disposed between adjacent heat transfer tubes.

13. The heat exchanger of claim 12, wherein each of said pair of headers has a plurality of tube insertion holes and a plurality of said burrs, wherein each of said burrs is formed around a corresponding tube insertion hole.

* * * * *

UNITED STATES PATENT AND TRADEMARK OFFICE

CERTIFICATE OF CORRECTION

PATENT NO : 5,787,973
DATED : August 4, 1998
INVENTOR(S) : KADO et al.

It is certified that error appears in the above-identified patent and that said Letters Patent is hereby corrected as shown below:

On the title page: Item

--[30] Foreign Application Priority Data

May 30, 1995 [JP] Japan ..... 7-154042--

Signed and Sealed this

Twenty-seventh Day of April, 1999

*Attest:*

Q. TODD DICKINSON

*Attesting Officer*

*Acting Commissioner of Patents and Trademarks*